US005829721A

United States Patent [19]

Jurik et al.

[11] Patent Number: 5,829,721

[45] Date of Patent: Nov. 3, 1998

[54] SUPPORT

[76] Inventors: Ladislav Jurik, 4533 S. Prairie Ave., Brookfield, Ill. 60513; Luke Wroblewski; Mieczyslaw Wroblewski, both of 24052 N. Elm Rd., Lake Forest, Ill. 60045

[21] Appl. No.: 834,533

[22] Filed: Apr. 4, 1997

[51] Int. Cl.[6] ..... B68G 5/00

[52] U.S. Cl. ..... 248/118; 248/118.5

[58] Field of Search ..... 248/118, 118.1, 248/118.3, 118.5, 188.2, 286.1, 346.01, 346.03, 346.05, 349, 349.1, 430, 458; 292/188.21, 411.26, 411.35, 411.38, 411.37; 384/29, 49, 52; 211/11, 12, 13

[56] References Cited

U.S. PATENT DOCUMENTS

| | | | |
|---|---|---|---|
| 451,632 | 5/1891 | Burdick | 248/458 |
| 477,113 | 6/1892 | Gruneberg | 384/592 |
| 568,380 | 9/1896 | Theiring | 182/230 |
| 821,704 | 5/1906 | Conway | 384/49 |
| 909,751 | 1/1909 | Butcher | 108/140 |
| 1,189,178 | 6/1916 | Severin | 248/430 |
| 1,510,877 | 10/1924 | Wiedenmann | 248/118.5 |
| 1,522,652 | 1/1925 | Setrakian | 248/118.5 |
| 1,627,635 | 5/1927 | Craig | 248/118.5 |
| 2,553,652 | 5/1951 | Gradle et al. | 248/430 |
| 3,222,105 | 12/1965 | Cross | 297/188.21 |
| 3,234,623 | 2/1966 | Rector | 27/21.1 |
| 3,259,355 | 7/1966 | Slouka | 248/430 |
| 3,360,306 | 12/1967 | Vargady | 384/29 |
| 3,762,275 | 10/1973 | Imamura | 90/58 C |
| 4,313,585 | 2/1982 | Bricker | 248/118.5 |
| 4,688,862 | 8/1987 | Fowler et al. | 312/325 |
| 5,158,257 | 10/1992 | Wilson | 248/346 |
| 5,201,485 | 4/1993 | Moss et al. | 248/118 |
| 5,232,190 | 8/1993 | Gould | 248/311.2 |
| 5,255,956 | 10/1993 | Stevens | 297/411.26 |
| 5,265,835 | 11/1993 | Nash | 248/118 |
| 5,335,888 | 8/1994 | Thomsen | 248/118.5 |
| 5,340,067 | 8/1994 | Martin et al. | 248/118.5 |
| 5,369,805 | 12/1994 | Bergsten et al. | 297/411.35 |
| 5,383,632 | 1/1995 | Shirlin et al. | 248/118.5 |
| 5,386,957 | 2/1995 | Miller | 248/118.5 |
| 5,398,896 | 3/1995 | Terbrack | 248/118.5 |
| 5,402,972 | 4/1995 | Schmidt | 248/118 |
| 5,405,109 | 4/1995 | Nordnes | 248/118.3 |
| 5,424,912 | 6/1995 | Mikan | 361/680 |
| 5,472,161 | 12/1995 | Krukovsky | 248/118.5 |
| 5,553,820 | 9/1996 | Karten et al. | 248/286.1 |
| 5,558,418 | 9/1996 | Lambright et al. | 312/321.5 |
| 5,571,274 | 11/1996 | Holstensson | 297/411.38 |
| 5,575,396 | 11/1996 | Smed | 211/11 |
| 5,593,128 | 1/1997 | Odom et al. | 248/346.01 |
| 5,597,207 | 1/1997 | Bergsten et al. | 297/411.35 |
| 5,601,264 | 2/1997 | Peart | 248/118.1 |
| 5,636,822 | 6/1997 | Hendershot et al. | 248/346.01 |
| 5,641,074 | 6/1997 | Smed | 211/11 |
| 5,655,743 | 8/1997 | Gillis | 248/346.1 |
| 5,655,814 | 8/1997 | Gibbs | 297/411.38 |
| 5,678,800 | 10/1997 | Markussen | 248/346.01 |
| 5,692,815 | 12/1997 | Murphy | 312/283 |

*Primary Examiner*—Leslie A. Braun
*Assistant Examiner*—Tan Le
*Attorney, Agent, or Firm*—Mark C. Bach

[57] ABSTRACT

A number of embodiments of a support for a portion of a limb of a user are described. In one embodiment, the support comprises a frame, and a platform movably connected with the frame such that the platform is variably positionable with respect to the frame. A supporting member is constructed to simultaneously support a wrist and a portion of an arm of the user. A supporting member bearing structure connects the platform with the supporting member such that the supporting member is multi-directionally movable with respect to the frame and the platform.

13 Claims, 10 Drawing Sheets

SUPPORT

BACKGROUND

Embodiments described herein generally relate to a support for a human limb. More specifically, the embodiments relate to a support for portions of a human arm and wrist during activities such as working with a computer and the like.

Computers have become an important tool in the lives of many people. To use the computer, a human operator may have to make entries by means of an input device, such as a keyboard, joy stick, a track ball, a mouse and the like. While doing this, the human operator may expose his or her arms, wrists and/or other body parts to numerous stresses. These stresses may result in operator fatigue or other undesirable conditions, such as those associated with carpal tunnel syndrome.

In order to relieve some of these stresses, and thereby increase comfort of the human operator, a number of supports have been designed. However, some of these supports may not provide sufficient stress reduction. With some other supports the construction may not be as "user friendly" as desired. Accordingly, there is a need to provide an improved support.

SUMMARY

A number of embodiments of a support for a portion of a limb of a user are described. In one embodiment, the support comprises a frame, and a platform movably connected with the frame such that the platform is variably positionable with respect to the frame. A supporting member is constructed to simultaneously support a wrist and a portion of an arm of the user. A supporting member bearing structure connects the platform with the supporting member such that the supporting member is multi-directionally movable with respect to the frame and the platform.

Another embodiment provides a support comprising a platform. A supporting member is constructed to simultaneously support a wrist and a portion of an arm of the user and is positioned adjacent the platform. A supporting member bearing structure removably connects the platform with the supporting member such that the supporting member is multi-directionally movable with respect to the platform.

DETAILED DESCRIPTION OF ILLUSTRATED EMBODIMENTS

Various embodiments of a support 10 for a human limb are described in the following paragraphs. The illustrated embodiments may be used to simultaneously support portions of a human arm and wrist. However, concepts disclosed in the embodiments may be modified in any appropriate manner to provide support for other limbs, human, synthetic, i.e. robotic, or otherwise. Furthermore, elements of one embodiment may be combined with elements of another embodiment to arrive at yet other embodiments. Accordingly, it is envisioned that the embodiments may be adapted in any suitable manner to arrive at an embodiment which meets requirements of a given application. For instance, it is contemplated that the embodiments may be employed by a person engaging in activities such as working with a computer and the like. Given the flexibility and adaptability of the embodiments of the support 10, specific embodiments are described in detail to facilitate understanding. It is to be noted, however, that the support 10 is not limited to the embodiments described or illustrated. As an example, the embodiments shown in the Figures are constructed to simultaneously support portions of a right arm and wrist. It is clear that an embodiment which is a mirror image of the embodiments illustrated would be employed to simultaneously support portions of a left arm and wrist.

Figure 1:
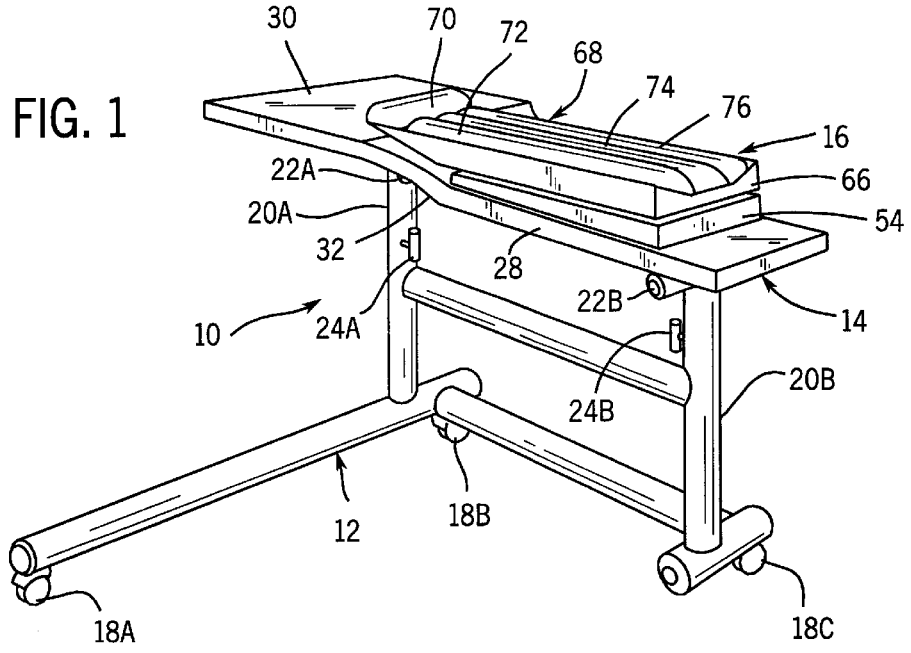
FIG. 1 is a perspective view of an embodiment described herein.

Referring to FIG. 1, an embodiment of the support 10 is shown. The support 10 generally comprises a frame 12, a platform 14 and a supporting member 16. The frame 12 is supported by movable members 18A, 18B and 18C, such as rollers, casters, low friction pads and the like, for facilitating variable placement of the support 10 within an ambient environment, such as an office, a cubicle and the like. The movable members 18A, 18B and 18C may include a locking mechanism, such as a compression member, a brake, a ratchet and the like, for maintaining a position of the frame 12 and the support 10 once the frame 12 is in a desired position with respect to the ambient environment. The frame 12 may be comprised of any suitable material, such as a metal, a wood, a synthetic material, such as a polymer, and the like. The frame 12 may be finished in a manner to compliment other elements, such as furniture and the like, of the ambient environment. In a particular embodiment, the frame 12 is made of metal tubing In some embodiments, the frame 12 may be modified to meet any desired requirements. For example, the frame 12 may be constructed such that the frame 12 may be fixedly or removably mounted to another surface, such as a desk, a file cabinet and the like. Alternatively, the frame 12 may be removed altogether. In such alternative embodiments, the platform 14 may be placed upon a support surface, may be levitated magnetically or pneumatically, etc. In other embodiments, the function of the platform 14 may be provided by another surface, such as a desk, a file cabinet and the like.

Figure 2:
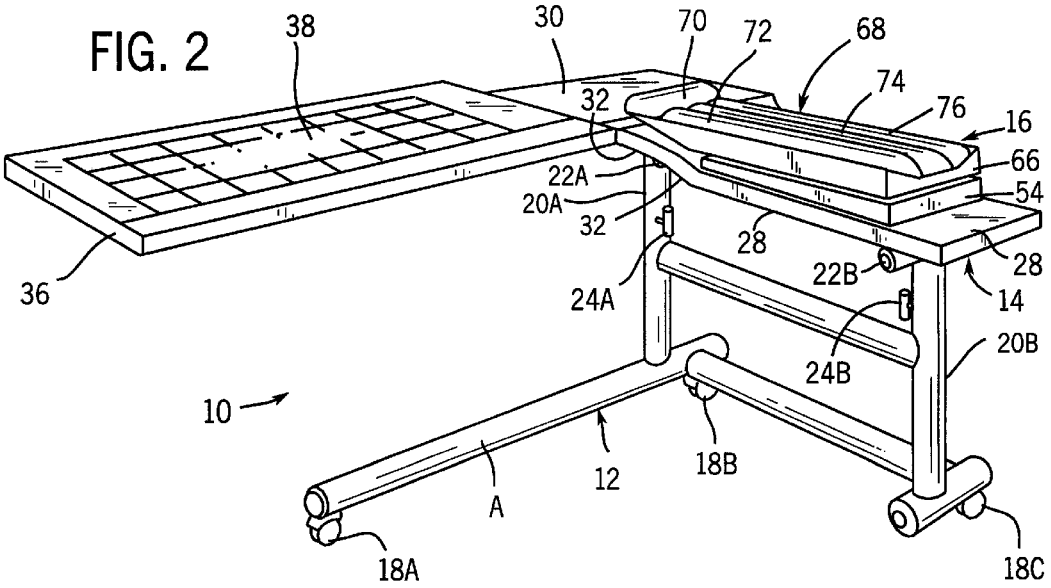
FIG. 2 is a perspective view of another embodiment described herein.
Figure 3:
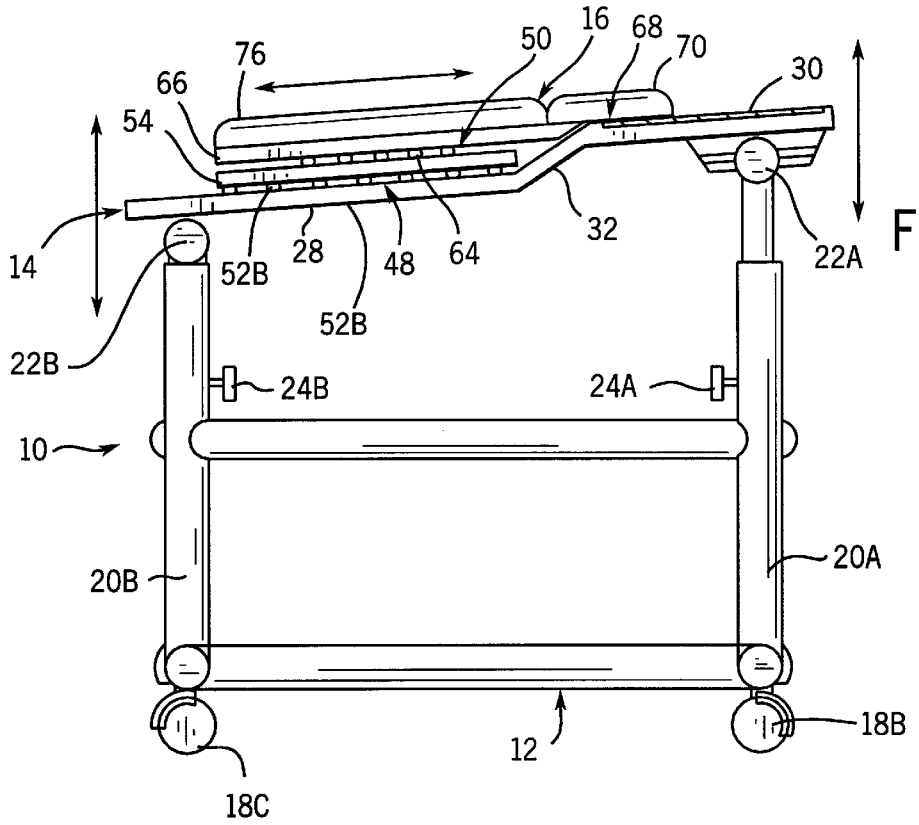
FIG. 3 is a side view of an embodiment described herein.

The platform 14 is movably attached to connecting members 20A and 20B comprising the frame 12 by pivot elements 22A and 22B, respectively. The pivot elements 22A and 22B allow the platform 14 to be located in various positions with respect to the frame 12. One such position is illustrated in FIGS. 1 and 2, another is illustrated in FIG. 3. The pivot elements 22A and 22B may take on a number of constructions. Generally, the pivot elements 22A and 22B may comprise a shaft connected with the connecting members 20A and 20B and a sleeve connected with the platform 14. The sleeve substantially coaxially surrounds the shaft such that the shaft and the sleeve are capable of relative rotation responsive to movement of the platform 14 with respect to the frame 12.

The connecting members 20A and 20B also provide for variable movement and/or positioning of the platform 14 with respect to the frame 12. The connecting members 20A and 20B may have a number of different constructions, such as telescopic elements, mechanical or pneumatic springs and the like. The connecting members 20A and 20B are independently variably positionable, as shown in FIG. 3, so that the platform 14 may be inclined at any desired angle with respect to the frame 12, so that the platform 14 and the supporting member 16 may be elevated at any desired elevation with respect to the frame 12, etc.

To control positioning of the connecting members 20A and 20B, control elements 24A and 24B are provided with the connecting members 20A and 20B, respectively. The control elements 24A and 24B also may take on a number of constructions, such as mating notches and detents, ratchets, compression fittings and the like. The control elements 24A and 24B are operable so that once the connecting members 20A and 20B are in their desired positions, the control elements 24A and 24B are engaged such that the connecting members 20A and 20B are maintained in their desired positions. If is were desired to move the connecting members 20A and 20B, then the control elements 24A and 24B are disengaged, thereby permitting movement of the connecting members 20A and 20B with respect to the frame 12.

Figure 4:
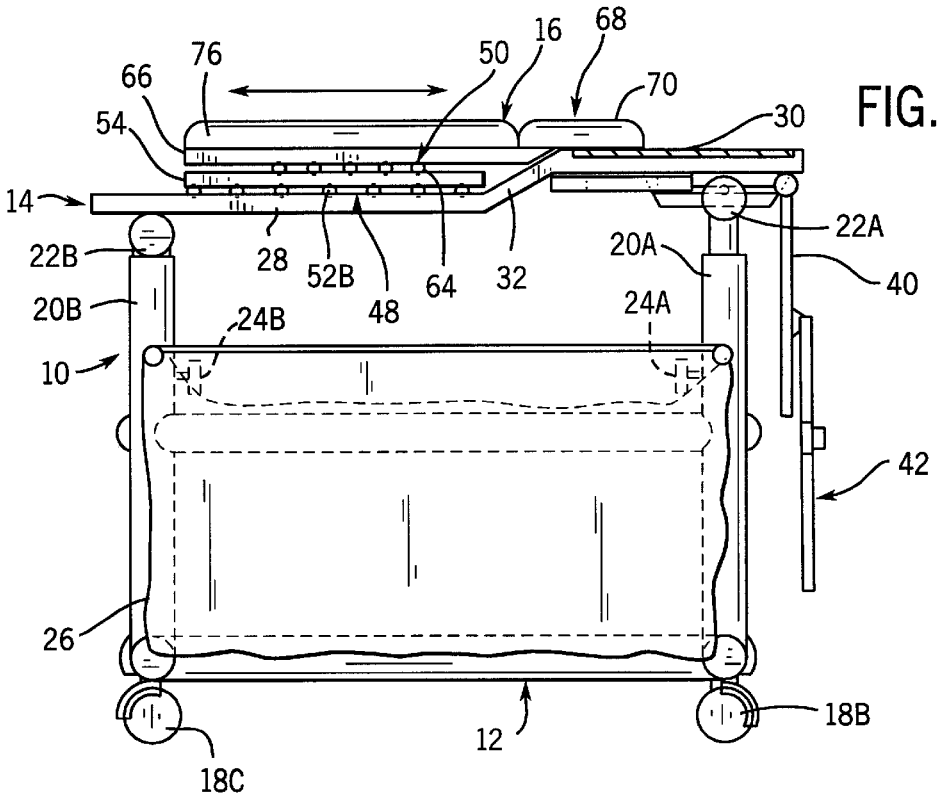
FIG. 4 is a side view of another embodiment described herein.

The frame 12 provides structures for supporting a variety of items for increasing convenience of a user. As shown in FIG. 4, a pouch 26 can be removably or fixedly attached to the frame 12. The pouch 26 may be made of any suitable material, such as a fabric, a polymer and the like. The pouch 26 may be dimensioned to accommodate any articles, such as books, personal items and the like. In some embodiments, the pouch 26 may be replaced with bins, such as in/out boxes, file trays and the like, for facilitating easy access of a user to items requiring attention.

Figure 5:
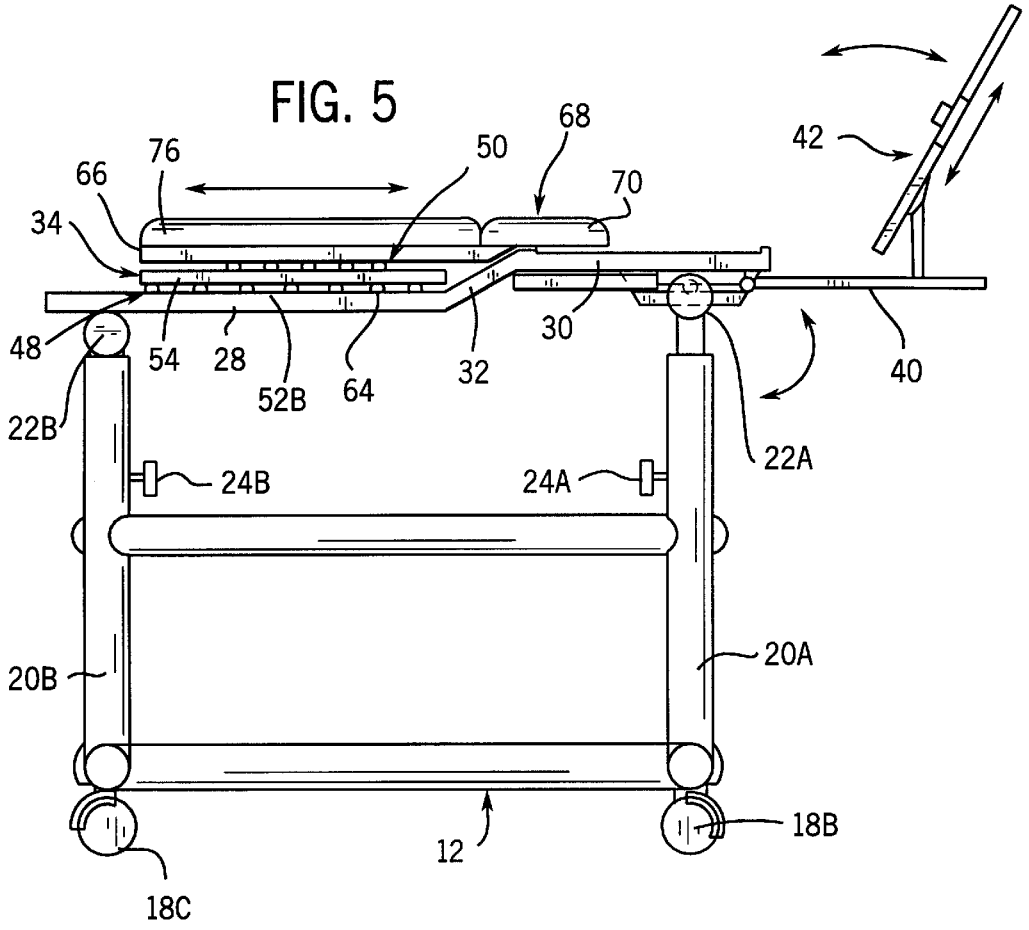
FIG. 5 is a view similar to that of FIG. 4 with the embodiment in another position.

In the embodiments illustrated in FIGS. 3, 4 and 5, the platform 14 comprises a first portion 28, a third portion 30 and a second portion 32 joining the first portion 28 and the third portion 30. The first portion 28 is connected with the connecting member 20B by the pivot element 22B and the third portion 30 is connected with the connecting member 20A by the pivot element 22A. The first portion 28 supports a supporting member 16 bearing structure 34 shown in detail in FIG. 9. The third portion 30 is dimensioned to support elements, such as a mouse and mouse pad, a track ball, a joy stick and the like, to be accessed by the supported limb of the user. In some embodiments, the third portion 30 may be detachable from the second portion 32 or may be provided as a separate piece.

Other structures may be associated with the platform 14. As shown in FIG. 2, a base 36 may be attached to the platform 14. In the embodiment illustrated, the base 36 is attached to the third portion 30 of the platform 14. The base 36 is configured to bear a keyboard 38. Other configurations of the base 36 may be used to bear other things, such as a light pen surface and the like. In some embodiments, the base 36 may be selectively positionable with respect to and/or removable from the platform 14.

Figure 7:
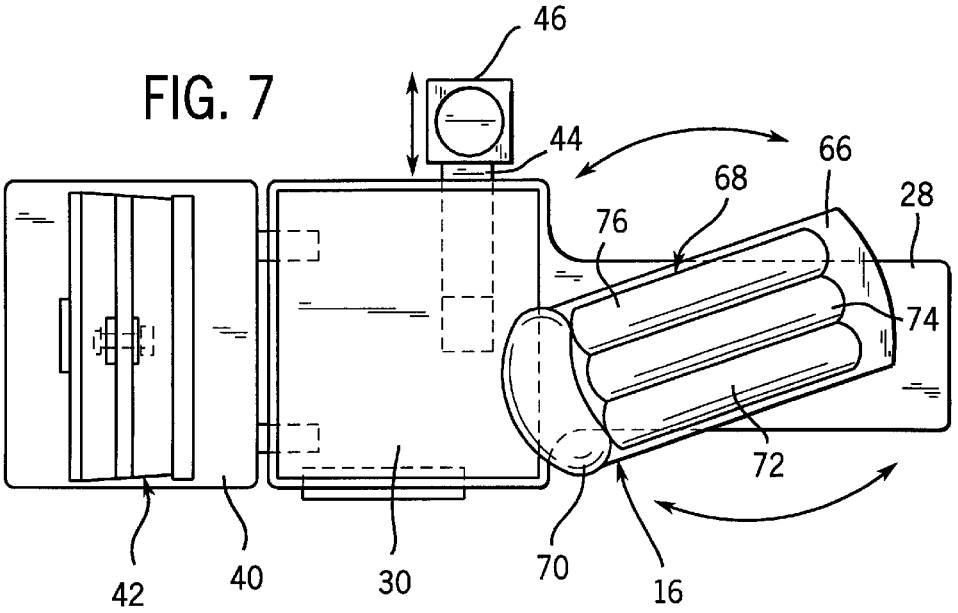
FIG. 7 is a top view of one construction of a portion of the embodiments shown in the other Figures.

An extension 40, shown in FIGS. 4, 5 and 7, may be associated with the platform 14. The extension 40 may be attached to the third portion 30 of the platform 14 and may be configured to bear various elements, such as a document support 42, a display device and the like. Both the extension 40 and the document support 42 may be attached such that the extension 40 and the document support 42 may be moved into a variety of positions.

A projection 44, shown in FIG. 7, may be associated with the platform 14. The projection 44 may be movably attached to the third portion 30 such that the projection 44 can move between an extended position, shown in FIG. 7, and a retracted position where the projection 44 resides adjacent a side of the third portion 30 opposite to a side thereof adjacent the supporting member 16. The projection 44 may bear a number of elements, such as a cup holder 46, a phone support and the like.

Figure 8:
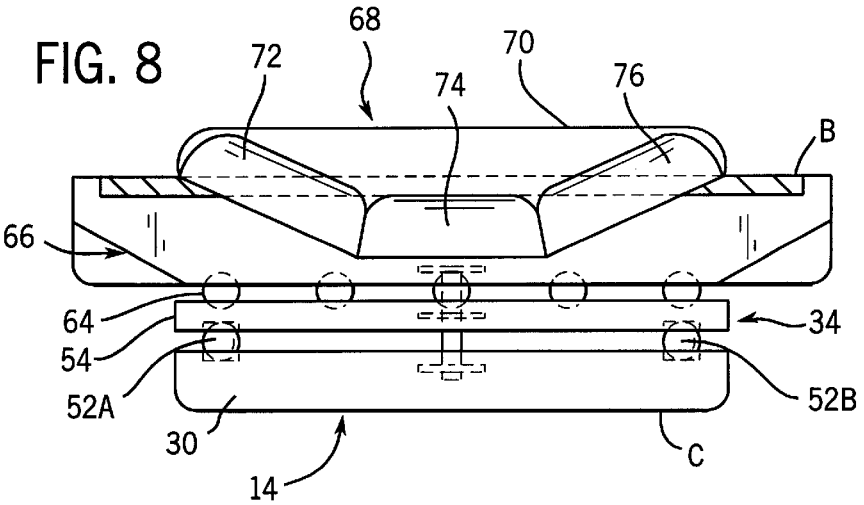
FIG. 8 is a side view of the portion shown in FIG. 7.
Figure 6:
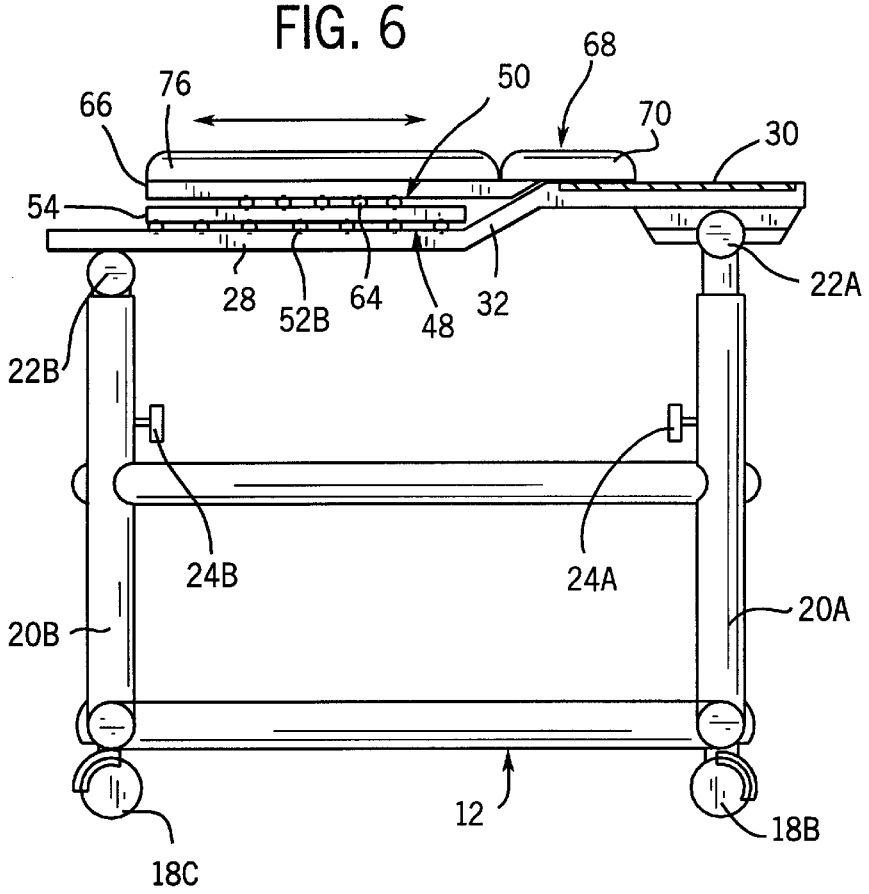
FIG. 6 is a view similar to that of FIG. 5 of another embodiment described herein.
Figure 9:
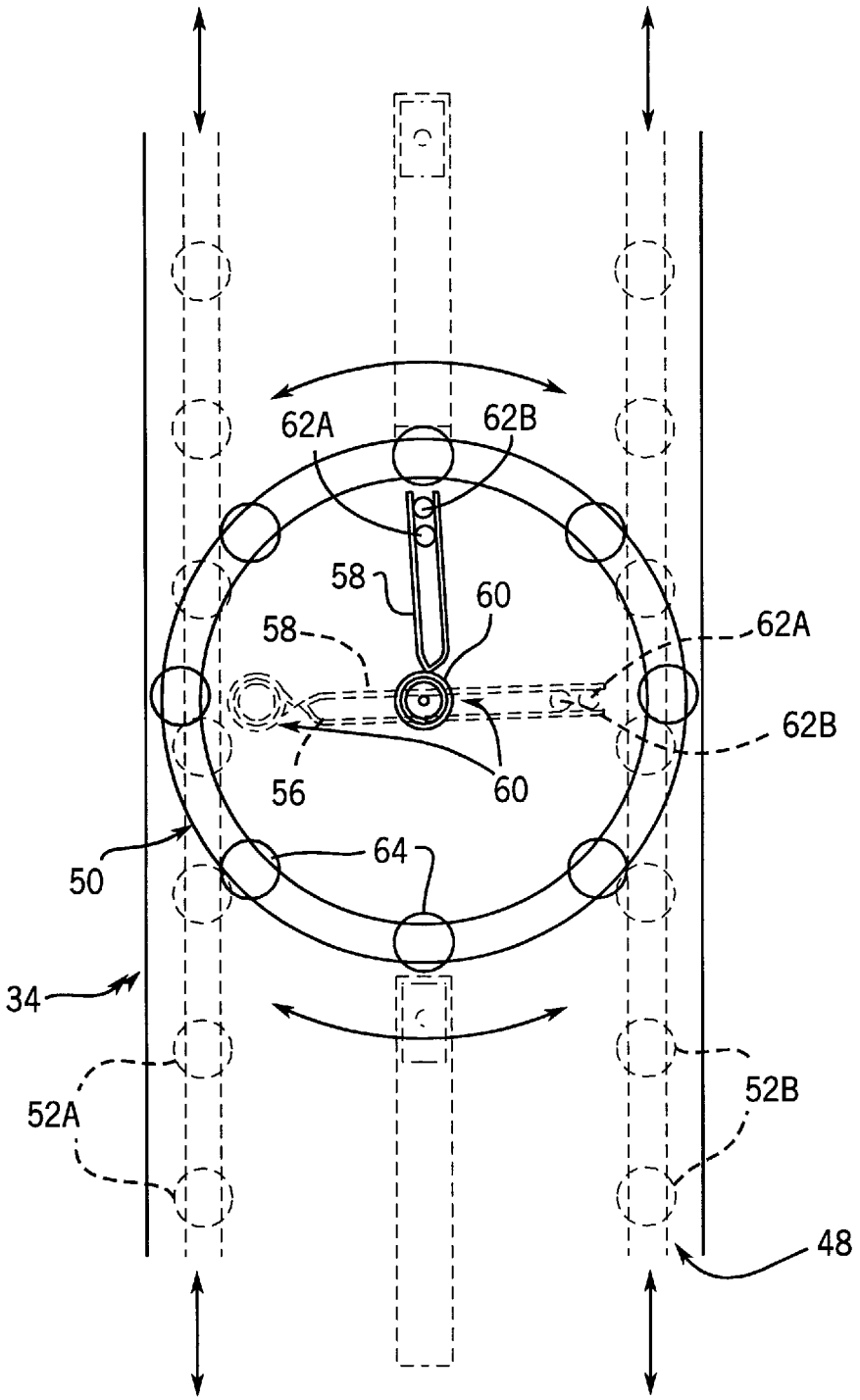
FIG. 9 is a top view of one construction of another portion shown in the previous Figures.

Referring to FIGS. 8 and 9, an exemplary embodiment of the supporting member 16 bearing structure 34 will be discussed. The bearing structure 34 permits the supporting member 16 to be moved multi-dimensionally with respect to the platform 14. The bearing structure 34 comprises a linear movement portion 48 and a rotational movement portion 50. The linear movement portion 48 includes a pair of substantially linearly arranged bearings 52A and 52B disposed between the first portion 28 of the platform 14 and a plate 54. The bearings 52A and 52B permit the plate 54 and the supporting member 16 to move linearly as shown by the arrows in FIGS. 5, 6 and 9.

To move the supporting member 16 and the plate 54 to a "rest" position, a return member 56 is provided. In a specific embodiment, the return member 56 comprises a spring 58, an anchor 60 and a pair of posts 62A and 62B. In some embodiments, the anchor 60 essentially defines an axis about which the supporting member 16 pivots. As will become clear later, although the anchor 60 is shown located substantially centrally with respect to the supporting member 16, the anchor 60 can be located at any desired position with respect to the supporting member 16. Thus, the supporting member 16 may be constructed to pivot about any desirable axis or axes.

Illustrating further by example, if the supporting member 16 and the plate 54 is moved in a first direction, i.e. the user moves the supporting member 16 with his arm/wrist, the post 62A moves with the supporting member 16 and the plate 54 away from the post 62B while the post 62B remains stationary. This places the spring 58 in a stressed condition. When a force applied by the user is removed, the spring 58 returns to an unstressed condition, thereby moving the post 62A towards the post 62B. This returns the supporting member 16 and the plate 54 towards the "rest" position which corresponds to the spring 58 being in the unstressed condition.

An exemplary embodiment of the rotational movement portion 50 comprises a substantially annular arrangement of bearings 64 which reside between the plate 54 and the supporting member 16. Thus, the bearings 64 allow the supporting member 16 to move rotationally, as shown by the arrows in FIGS. 7 and 9, with respect to the frame 12. The rotational movement portion 50 also includes a return member 56, substantially similar to the return member 56 of the linear movement portion 48, hence the like reference numerals. As the supporting member 16 rotates counterclockwise, as viewed in FIG. 9, under the influence of a force applied by the user, the post 62A moves with the supporting member 16 away from the post 62B which remains stationary, thereby placing the spring 58 in a stressed condition. When the user applied force is removed, the spring 58 returns towards its unstressed condition thereby moving the post 62A clockwise towards the post 62B and the supporting member 16 towards the "rest" position. In another embodiment, both of the posts 62A and/or 62B may both be movable conjointly with the supporting member 16, albeit possibly movable in opposite directions.

Referring to FIGS. 7 and 8, an exemplary construction of the supporting member 16 is discussed. The supporting member 16 generally comprises a base 66 and a pad 68. The base 66 is configured to compliment a corresponding configuration of the pad 68. The pad 68 may be attached to the base 66 in any appropriate manner, such as by an adhesive, with a hook and loop material, etc.

The pad 68 is constructed to provide cushioning simultaneously support to portions of a limb of a user. In the illustrated embodiments, as the portions of the limb of interest are a human arm and wrist, the pad 68 is structured specifically to meet that need. However, if another limb is intended to be supported, then the pad 68 may take on a different configuration.

As shown in the Figures, the pad 68 includes a first portion 70, a second portion 72, a third portion 74 and a fourth portion 76. The first portion 70 is oriented substantially perpendicularly to the second, third and fourth portions 72, 74 and 76. The first portion 70 is disposed substantially transversely to an axis of elongation of the plate 54. The first portion 70, in the illustrated embodiment, is substantially arcuate in profile. The first portion 70 is intended to support a portion of the user's wrist and, as such, can take on any appropriate construction.

The second, third and fourth portions 72, 74 and 76 are intended to simultaneously support a portion, i.e. forearm, of the user s arm. The second, third and fourth portions 72, 74 and 76 extend substantially orthogonally to the first portion 70. One end of the second, third and fourth portions 72, 74 and 76 may abut a portion of the first portion 70. The third portion 74 is located between the second portion 72 and the fourth portion 76 and lies substantially paralellely to the plate 54. One elongated side of the second portion 72 opposes first elongated side of the third portion 74 and one elongated side of the fourth portion 76 opposes a second elongated side the third portion 74. The second portion 72 and the fourth portion 76 are inclined with respect to the third portion 74 such that the second, third and fourth portions 72, 74 and 76 form a trough or channel for simultaneously supportively accepting a portion of the user's arm and wrist.

To illustrate construction of the support 10 in greater detail, the following exemplary dimensions are given. It is to be remembered that the exemplary dimensions given are for the sake of facilitating understanding. The dimensions may be modified in any desirable manner and may be chosen dependent upon a number of factors, such as the ambient environment, the user, etc.

Referring to FIG. 2, a member A of the frame 12 may be about 22 inches long and the base 36 may extend about 19.5 inches from the third portion 30 of the platform 14. Drawing attention to FIG. 3, the connecting members 20A and 20B are offset from each other by a distance measuring about 15 inches and are about 1.5 inches wide. In the inclined position of FIG. 3, the first portion 28 is offset from the movable member 18C by a distance measuring about 21 inches while the third portion 30 is offset from the movable member 18B by a distance measuring about 27 inches. The platform 14 is about 5 inches wide and about 20 inches long. The base 66 is about 9.25 inches wide and about 13 inches long. A distance between a top surface B of the base 66 and a bottom surface C of the platform 14 (FIG. 8) measures about 2 inches. The pad 68 is about 0.875 inches thick and extends across substantially the entire length of the base 66 with the first portion 70 of the pad 68 being about 3 inches in width along an axis of elongation of the base 66.

Figure 10:
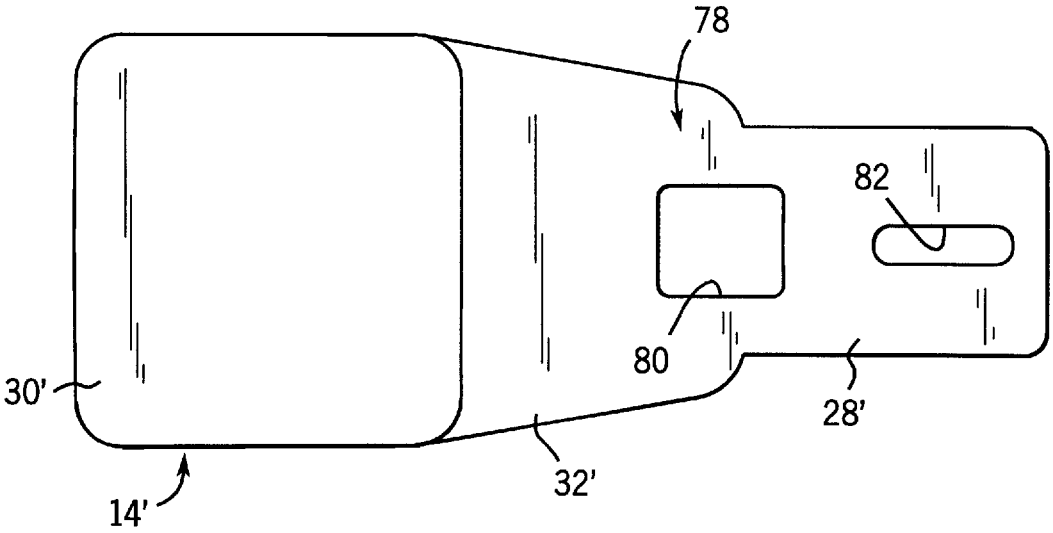
FIG. 10 is a top view of a portion of another embodiment described herein.
Figure 11:
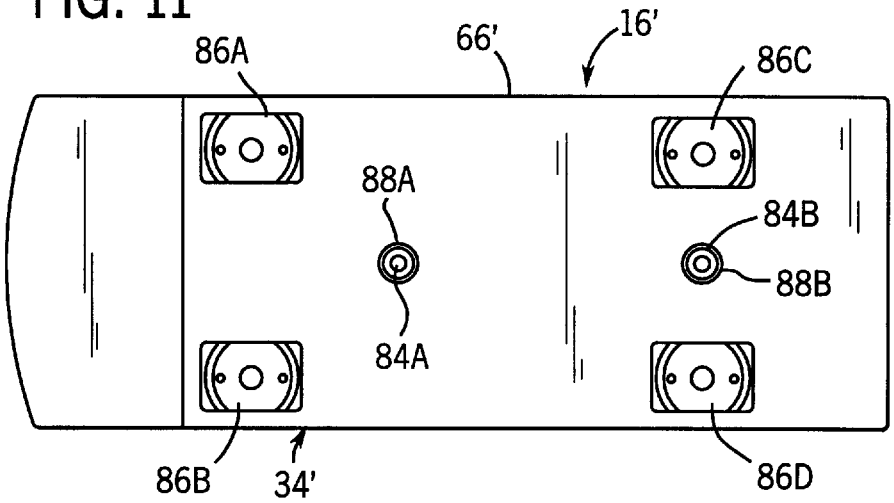
FIG. 11 is a bottom view of a portion which mates with the portion of FIG. 10.

Turning to FIGS. 10 and 11, another embodiment of the support 10 will now be described. This embodiment is substantially similar to the embodiments described previously, hence the like reference characters for similar structures. However, for clarity of understanding, the like reference characters include a'.

The platform 14' shown in FIG. 10 may be substantially planar such that the platform 14' may be placed upon any desirable supporting structure, such as a frame 12, a desk top, a file cabinet, a user's leg and the like. Thus, there may be no change in elevation or incline with respect to the portions 28', 30' and 32'. A surface 78, opposite to a surface placed upon the supporting structure, is sufficiently smooth and substantially frictionless to facilitate movement of the supporting member 16' with respect to the platform 14'. The platform 14' includes a first aperture 80 and a second aperture 82 for accepting projections 84A and 84B, respectively, disposed on the supporting member 16'. The apertures 80 and 82 are dimensioned and configured to provide a desired range of movement of the supporting member 16' with respect to the platform 14', as is discussed in greater detail below.

The supporting member 16' is releasably engagable with the platform 14' such that the supporting member 16' is multi-directionally movable with respect to the platform 14'. Specifically, the supporting member 16' includes a supporting member 16' bearing structure 34' that is releasably engagable with the platform 14'. In one embodiment, the bearing structure 34' comprises at least one roller or caster. In the embodiment illustrated in FIG. 11, the bearing structure 34' comprises four casters 86A, 86B, 86C and 86D positioned adjacent corners of the supporting member 16'. The casters 86A, 86B, 86C and 86D engage and move along the surface 78 of the platform 14' responsive to a force applied by the user.

To positively limit movement of the supporting member 16' with respect to the platform 14', the supporting member 16' includes the projections 84A and 84B. When the supporting member 16' is positioned as intended with respect to the platform 14', the projections 84A and 84B are located within the apertures 80 and 82 on the platform 14'. Contact between the apertures 80 and 82 and the projections 84A and 84B, respectively, limits movement of the supporting member 16' with respect to the platform 14'. In some embodiments, cushions 88A and 88B, such as elastomeric coatings, O-rings, bumpers and the like, may be provided with the apertures 80 and 82 and/or the projections 84A and 84B to cushion engagement among those elements.

To further clarify construction of these embodiments, the following dimensions are given as an example. For instance, the platform 14' may be about 20 inches long and about 9.5 inches wide at the third portion 30' and about 5 inches wide at the first portion 28'. The aperture 80 is approximately square having a side measuring about 2.6 inches. A side of the aperture 80 closest to the third portion 30' is spaced about 8 inches from an opposite end of the first portion 28'. The aperture 82 is about 2.6 inches long and about 0.6 inches wide. The supporting member 16' is about 14 inches long and about 5 inches wide.

Figure 12:
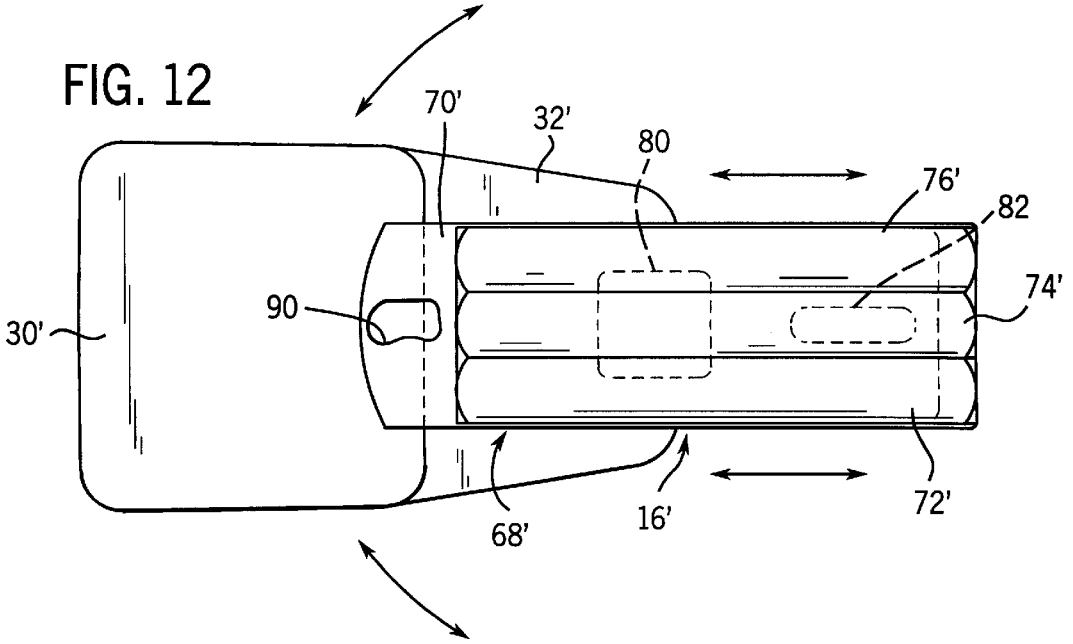
FIG. 12 is a top view of one embodiment including the portions of FIGS. 10 and 11.
Figure 13:
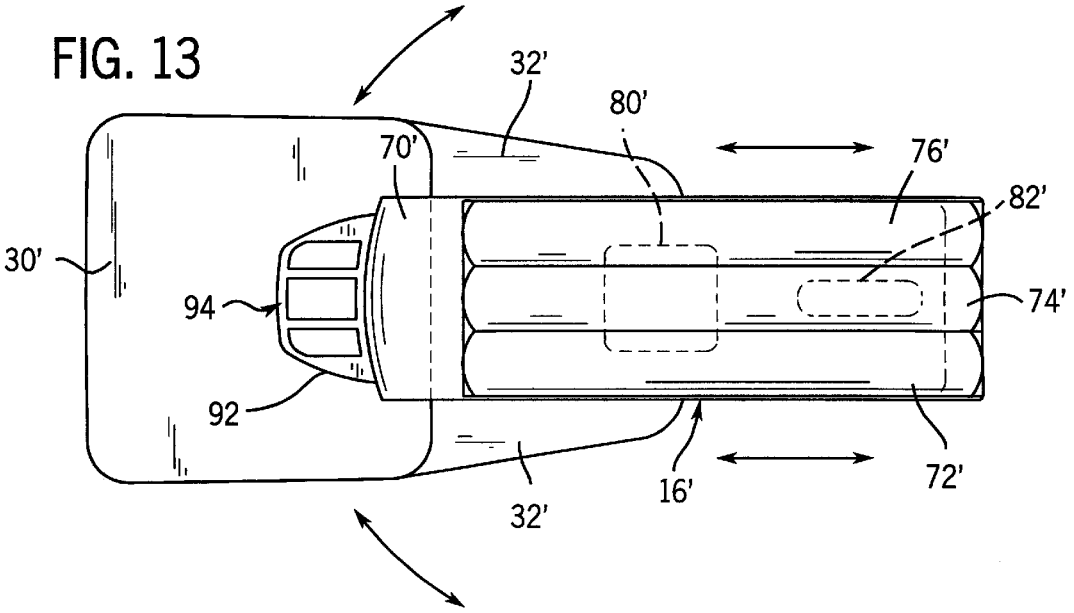
FIG. 13 is a top view of another embodiment including the portions of FIGS. 10 and 11.
Figure 14:
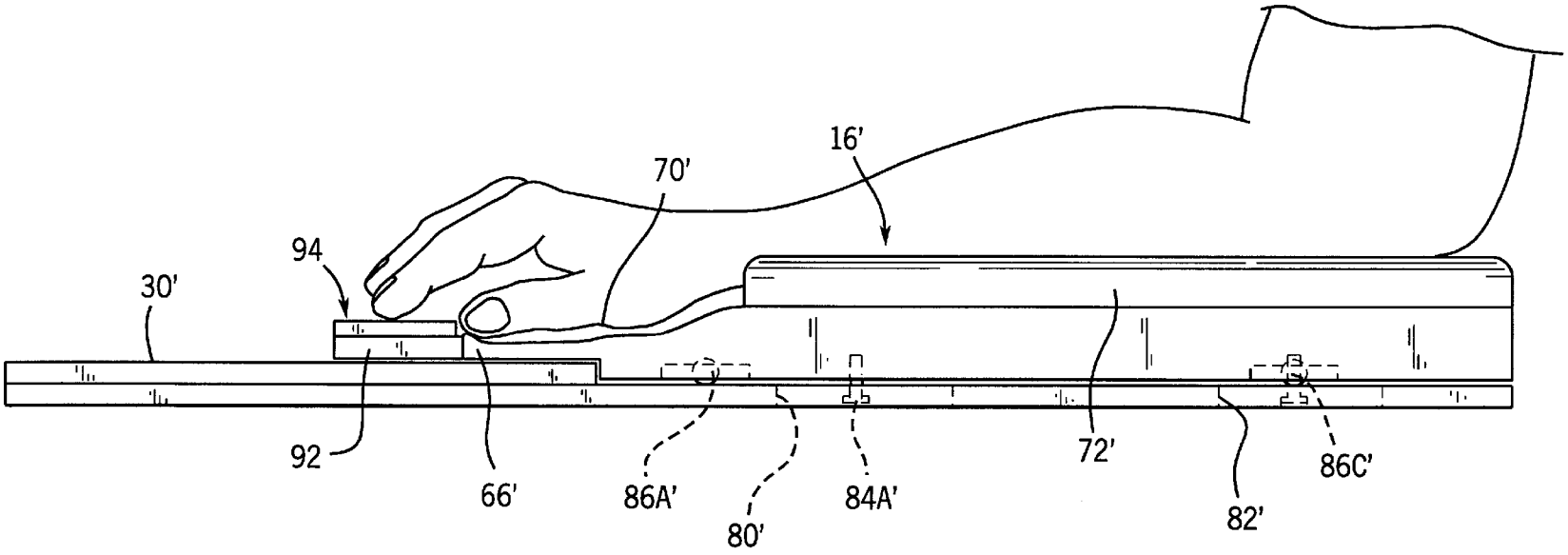
FIG. 14 is a side view of yet a further embodiment described herein showing its relation with respect to a limb of a user.
Figure 15:
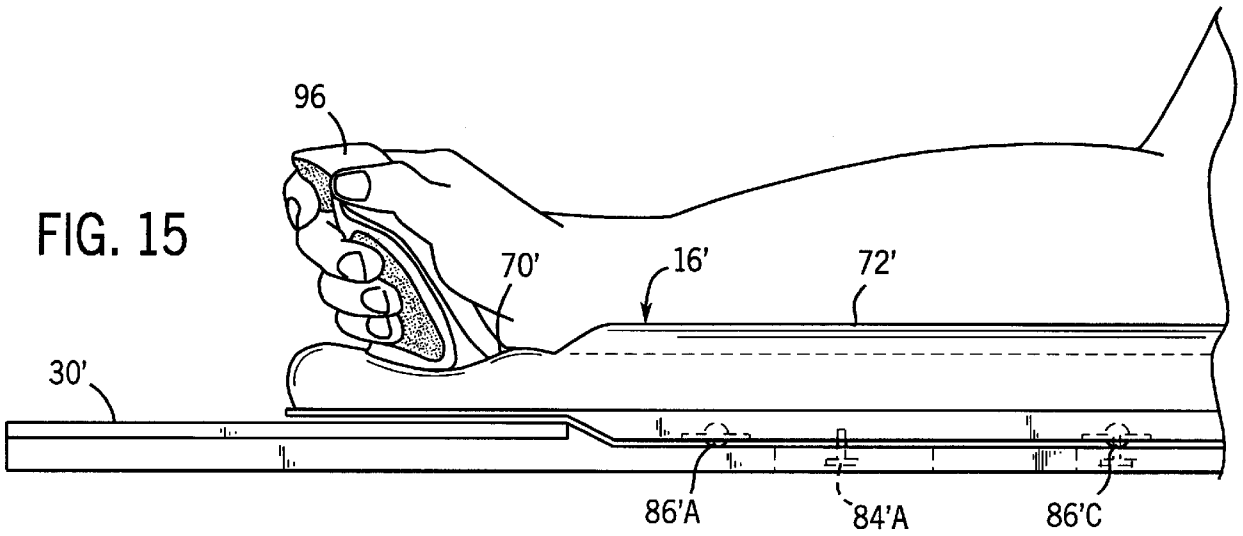
FIG. 15 is a view similar to that of FIG. 14 of an additional embodiment described herein.

FIGS. 12, 13 and 14 show further variations of the embodiment of FIGS. 10 and 11. FIG. 12 illustrates an aperture 90 formed in the first portion 70' of the pad 68'. The aperture 90 is configured to accept a controller 94, such as a joy stick and the like. In an alternative embodiment, such as that illustrated in FIG. 15, a controller 96, such as a joy stick, a mouse, a light pen and the like, may be permanently of removably inserted through the aperture 90 or permanently or removably joined with the base 66' or other suitable structures of the support 10. The controller 96 may be connected so as to allow for substantially free movement of the controller 96 in one desired direction, e.g. vertical, while limiting movement of the controller 96 in another direction, e.g. Horizontal.

Returning to FIG. 13, a clip 92 is illustrated extending from a portion of the base 66 adjacent the first portion 70' of the pad 68'. The clip 92 releasably connects a controller 94, such as a mouse, control switches and the like, with the base 66' such that the controller 94 is accessible to the user's hand, as illustrated in FIG. 14. The clip 92 allows the controller 94 to move vertically with respect to the third portion 30' and the base 66' while also allowing the controller 94 to move multi-directionally with the supporting member 16'.

It is to be noted that, while portions of the user's arm and wrist are shown in a particular orientation with respect to the supporting member 16' in FIG. 14, the supporting member 16', and more particularly the pad 68, of any embodiment described herein may be constructed in an appropriate fashion to support a portion of the user's arm and wrist in any desirable position. For example, it is possible with any of the embodiments to support a portion of the user's arm and wrist in an orientation that is rotated approximately 90 degrees with respect to the orientation shown in FIG. 14.

Figure 17:
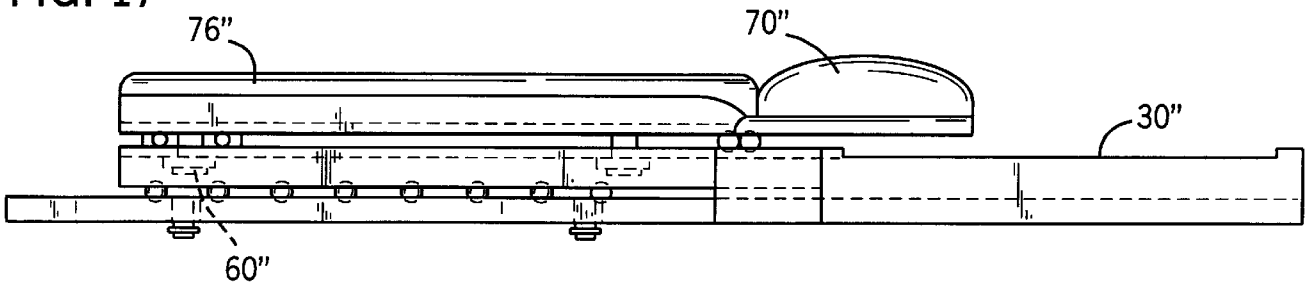
FIG. 17 is a side view of the embodiment of FIG. 16.
Figure 16:
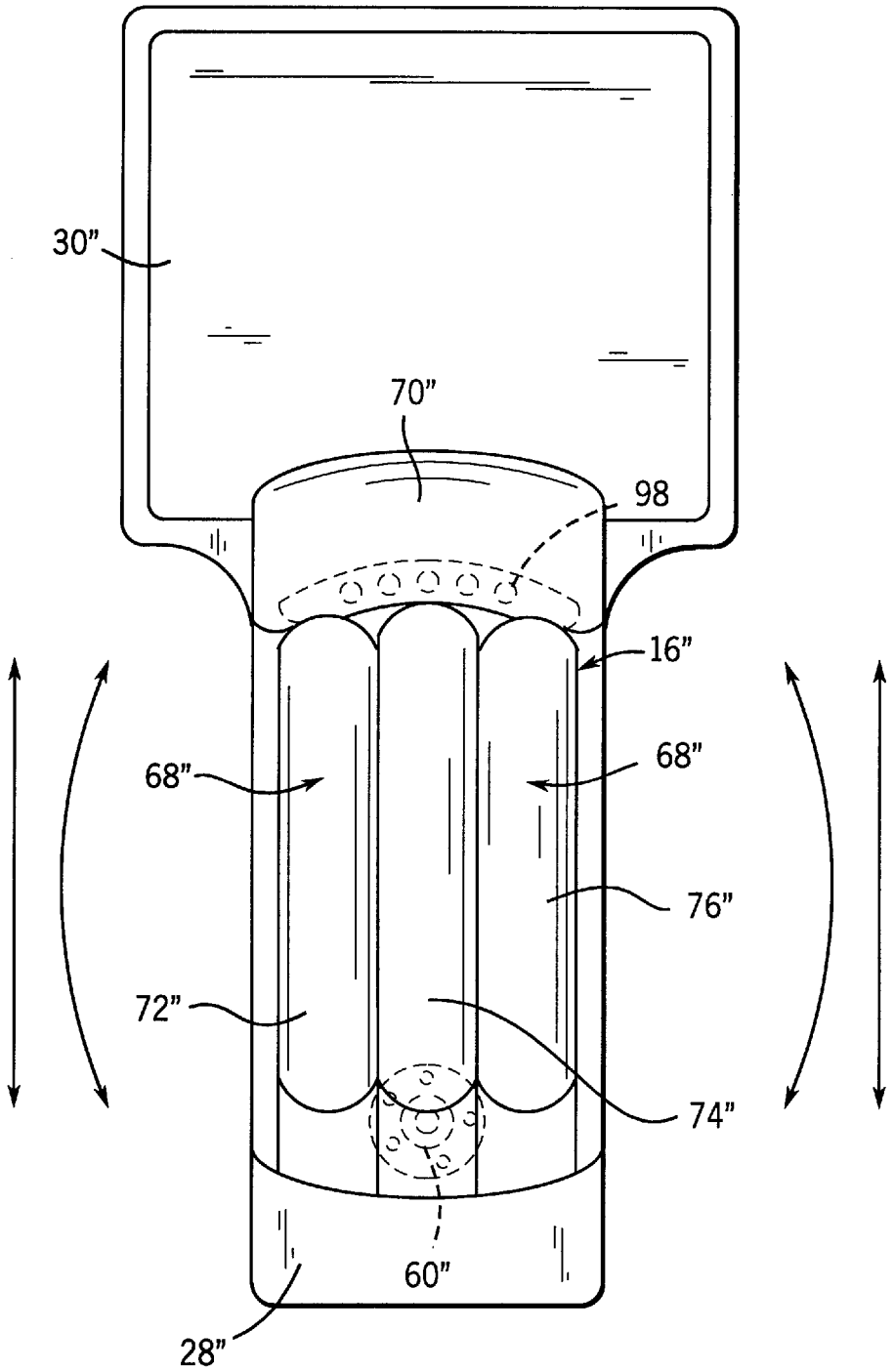
FIG. 16 is a top view of another embodiment described herein.

A further embodiment of the support 10 is shown in FIGS. 16 and 17. This embodiment includes structures substantially similar to those discussed earlier, hence like reference characters. However, in these Figures, the common elements are indicated by " after the reference character.

The embodiment illustrated in FIGS. 16 and 17 shows that the anchor 60", i.e. an axis about which the supporting member 16" may pivot, may be located at any desired position. In a particular embodiment, the anchor 60" is formed by a trust ball bearing located between the base 66" and the plate 54". A substantially annular array of supports 98, such as bearings and the like, is provided between the base 66" and the plate 54" adjacent the first portion 70" of the pad 68" to offer sufficient sliding support to the base 66". The base 66" also includes casters 86A, 86B, 86C and 86D (not shown) such that the supporting member 16" remains multi-directionally movable with respect to the platform 14" or other structure supporting the plate 54".

What is claimed is:

1. A movable support for a forearm and wrist of a user, the movable support comprising:

(a) a frame;

(b) a platform movably connected with the frame (a) such that the platform (b) is variably positionable with respect to the frame (a);

(c) a supporting member constructed to simultaneously support the forearm and wrist of the user, the supporting member (c) including a first portion which supports the wrist of the user and at least a second portion, attached to the first portion, which supports the forearm of the user, the second portion having a length which is adapted to extend underneath the forearm of the user; and (d) a supporting member bearing structure connecting the platform (b) with the supporting member (c) such that the supporting member (c) is multi-directionally movable with respect to the frame (a) and the platform (b), the supporting member bearing structure (d) including a linear movement portion for providing linear movement of the supporting member (c) with respect to the frame (a) and the platform (b) and a rotational movement portion for providing rotational movement of the supporting member (c) with respect to the frame (a) and the platform (b) whereby movement between the platform (b) and the frame (a) is in response to movement of the forearm or the wrist of the user.

2. A support as defined in claim 1 further comprising:

(e) a pouch connected with the frame (a).

3. A support as defined in claim 1 further comprising:

(e) a pivot element movably connecting the frame (a) with the platform (b).

4. A support as defined in claim 1 wherein the platform (b) comprises a third portion dimensioned to support an element such that the element is accessible to a user.

5. A support as defined in claim 1 further comprising (e) a base associated with the platform (b) for bearing a keyboard.

6. A support as defined in claim 1 further comprising:

(e) an extension associated with the platform (b) for bearing a display device.

7. A support as defined in claim 1 further comprising:

(e) a projection movably attached to the platform (b) such that the projection moves between an extended position and a retracted position.

8. A support as defined in claim 7 wherein the projection (e) bears a cup holder.

9. A support as defined in claim 1 wherein the supporting member bearing structure (d) includes a return member for returning the supporting member (c) towards a "rest" position.

10. A support as defined in claim 1 wherein the supporting member (c) includes a pad.

11. A support as defined in claim 10 wherein the pad includes a portion for supporting a portion of the user's wrist.

12. A support as defined in claim 1 further comprising:

(e) a controller releasably connected with the supporting member such that the controller (e) is accessible to the user and such that the controller is multi-directionally movable with the supporting member (c).

13. A movable support for a forearm and wrist of a user, the movable support comprising:

(a) a platform;

(b) a supporting member constructed to simultaneously support the forearm and wrist of the user, the supporting member (b) including a first portion which supports the wrist of the user and at least a second portion, attached to the first portion, which supports the forearm of the user, the second portion having a length which is adapted to extend underneath the forearm of the user; and (c) a supporting member bearing structure removably connecting the platform (a) with the supporting member (b) such that the supporting member (b) is multidirectionally movable with respect to the platform (a), the supporting member bearing structure (c) including a linear movement portion for providing linear movement of the supporting member (b) with respect to the platform (a) and a rotational movement portion for providing rotational movement of the supporting member (b) with respect to the platform (a) whereby movement of the supporting member (b) is in response to movement of the forearm or the wrist of the user.

* * * * *